US005207581A

United States Patent [19]

Boyd

[11] Patent Number: 5,207,581

[45] Date of Patent: May 4, 1993

[54] WRITING APPARATUS INCLUDING ELECTRET FILM

[76] Inventor: Steven L. Boyd, P.O. Box 1525, Corrales, N. Mex. 87048

[21] Appl. No.: 555,255

[22] Filed: Jul. 19, 1990

[51] Int. Cl.[5] ..... B43L 1/00; G09F 11/18

[52] U.S. Cl. ..... 434/412; 434/413; 434/426; 40/514; 40/594

[58] Field of Search ..... 40/514, 116, 594; 434/408, 409, 410, 411, 412, 413, 428, 421, 426

[56] References Cited

U.S. PATENT DOCUMENTS

| | | | |
|---|---|---|---|
| 601,416 | 3/1898 | Harrison | 40/514 X |
| 1,001,402 | 8/1911 | Hindle | 40/514 X |
| 1,966,276 | 7/1934 | Armstrong | 40/514 |
| 4,670,794 | 6/1987 | Araki et al. | 434/412 X |
| 4,741,119 | 5/1988 | Baryia | 40/594 |
| 5,010,671 | 4/1991 | Stonehouse | 40/594 |

FOREIGN PATENT DOCUMENTS

| | | | |
|---|---|---|---|
| 124402 | 4/1931 | Fed. Rep. of Germany | 40/514 |

*Primary Examiner*—John J. Wilson
*Assistant Examiner*—L. Thomas
*Attorney, Agent, or Firm*—Reed Smith Shaw & McClay

[57] ABSTRACT

Writing apparatus includes flexible electret film, capable of being erasably written upon with dry erase markers, as a writing medium. The apparatus includes a roll of electret film in a receptacle, brackets for mounting the receptacle to a wall or a conventional flip chart stand, and a cutter to separate the material into sheets.

3 Claims, 3 Drawing Sheets

WRITING APPARATUS INCLUDING ELECTRET FILM

BACKGROUND OF THE INVENTION

This invention relates to writing apparatus which includes an electret film as a means of receiving writing. More particularly, this invention relates to apparatus for facilitating the use of an electret film as a writing surface in presentation, display, and educational applications.

Paper has long been the predominant writing medium. However, it has suffered from certain drawbacks when used in the educational, presentation, and display fields, primarily resulting from the fact that paper is not transparent, is not easily erased and reused, and is not self-adherent.

In presentation and display applications, large pads of paper commonly known as flip charts are often affixed to an easel-like flip chart stand to hold them upright and are written upon by a speaker during the course of a presentation in order to illustrate and/or record his presentation. Such a presentation system has certain disadvantages. The paper is not easily erased and reused, and so unless the presentation is to consist merely of display of prerecorded information on successive sheets of the pad, the used sheets must be discarded after each presentation and the information written anew during the next presentation. This entails considerable expense, as well as inconvenience due to interruption of the presentation process for information to be written. It is also difficult with such flip charts to intermix preprinted information with information to be written by the speaker during the course of a presentation. Moreover, because paper is substantially opaque, the speaker cannot write new information against a background of information which was previously recorded on a separate sheet.

In order to overcome certain limitations of paper, various erasable and reusable writing media have been developed. These include chalk boards and, more recently, boards having surfaces adapted to be written upon with dry erase markers, to provide easily erasable and reusable surfaces. However, these writing media provide substantial limitations as well. They are restricted in area, and it is inconvenient to devote a portion of such area to information which is to be retained for long periods of time while other portions are erased and reused. They also do not facilitate successive writings and erasures against a background of prerecorded information.

Such drawbacks also exist in the use of paper in the educational environment. For instance, large amounts of paper are used by students in handwriting practice. Such practice and writing instruction is preferably carried out against a lined background to assist students in visualizing and controlling their writing with respect to size, spacing, and alignment of characters. While students may use paper having such a background preprinted upon it, this renders such paper unsuitable for other uses.

Others have suggested, prior to the filing date of this application, the use of plastic films which may be erasably written upon and which may adhere to a surface by "static cling". See, e.g. Canadian Patent No. 1,264,780.

It has been discovered that electret films may be erasably written upon, for instance with dry erase markers. Such electret films may be made either transparent or substantially opaque, and are self-adherent to most surfaces for extended periods of time.

SUMMARY OF THE INVENTION

This invention is directed to writing apparatus incorporating such electret films as a writing medium for use in educational, presentation, display and similar applications. The apparatus of the invention includes a plate for receiving an electret film to which the film will adhere by static electric attraction and for supporting the film during writing; a supply of electret film; means for disposing the electret film adjacent the plate; and means for delivering electret film from the supply to the plate in sheet form.

The foregoing and other features of the invention will be better understood with reference to the drawings and the detailed description thereof.

DETAILED DESCRIPTION OF THE PREFERRED EMBODIMENTS

Figure 1:
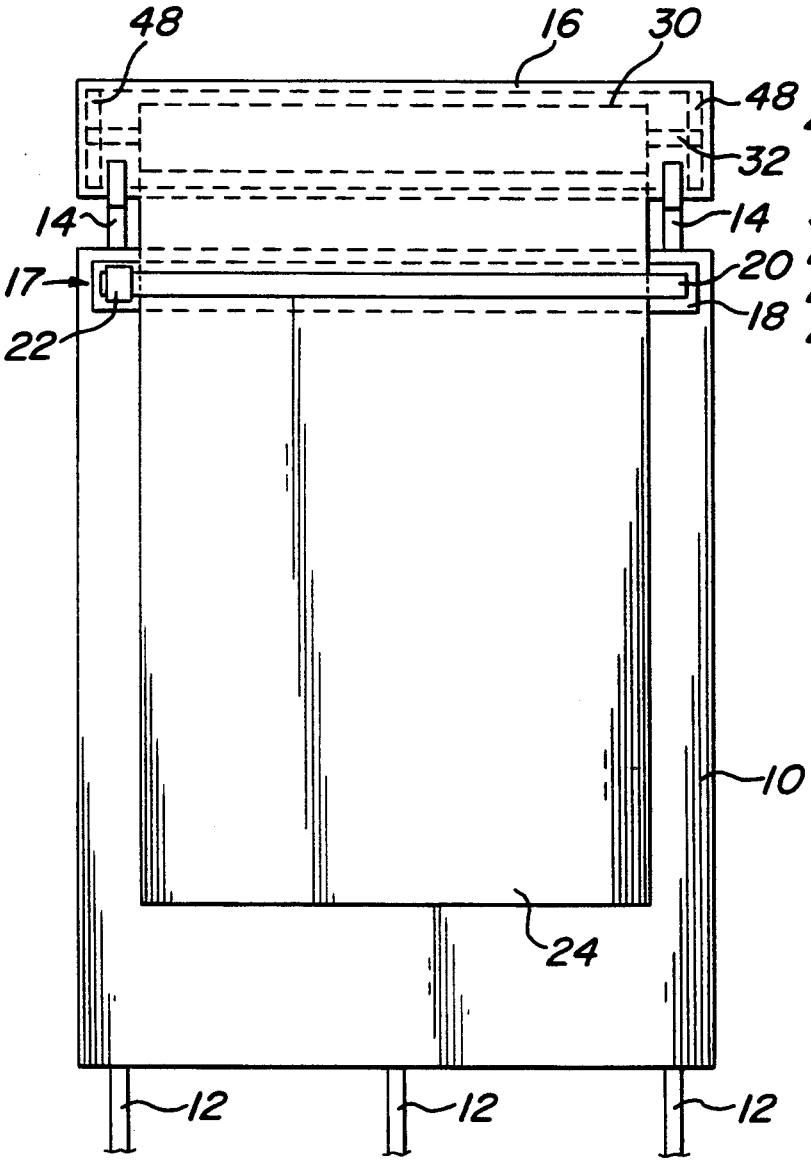
FIG. 1 is an illustration of the general features of a first embodiment of the invention.
Figure 2:
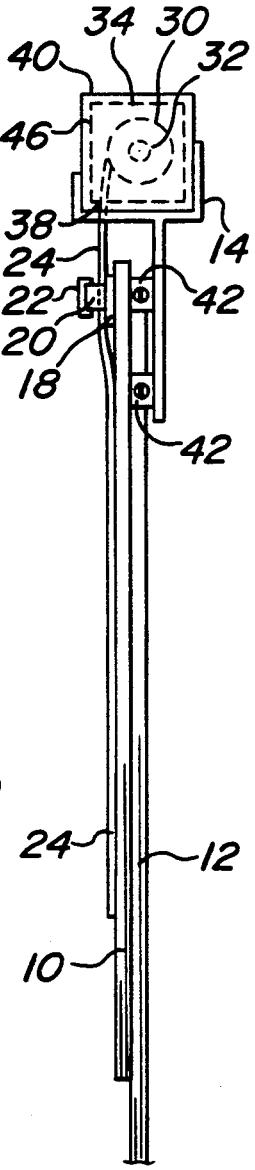
FIG. 2 is a side view of the first embodiment of the invention shown in FIG. 1.
Figure 3:
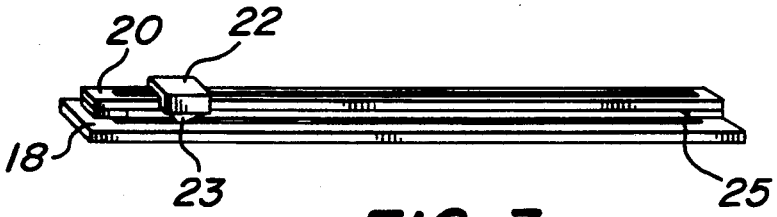
FIG. 3 is an illustration of a cutting assembly useful in the first embodiment of invention.
Figure 4:
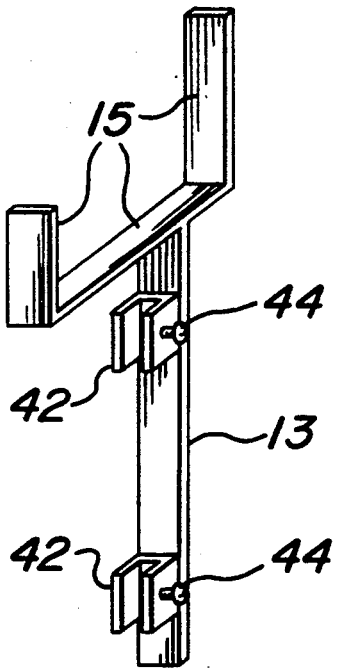
FIG. 4 is an illustration of the bracket of the first embodiment of the invention.

FIG. 1 shows the general features of the invention in an embodiment which may substitute for conventional paper flip charts in various presentation, display, and educational applications. FIG. 2 is a more detailed side view of the apparatus in FIG. 1, and FIGS. 3 and 4 are perspective illustrations of the cutting assembly and the brackets of the first embodiment shown in FIGS. 1 and 2. The apparatus of the first embodiment includes a plate 10 providing a generally flat surface for supporting an electret film 24 during writing thereon. Because electret films are adherent to most materials, plate 10 may be made from a variety of structurally suitable materials including metal, plastic and others. Plate 10 desirably has fixed to it means such as legs 12 for supporting plate 10 in a generally vertical orientation during use. Desirably, plate 10 and legs 12 comprise a standard flip chart stand, such as is in common use, and the other components of the apparatus to be described hereinafter are adapted to be detachably coupled to the flip chart stand. This facilitates portability, since only a portion of the display apparatus need be transported from place to place, which portion may be used with standard flip chart stands often available at locations where presentations are to be performed.

The electret film of the invention is known per se. It may consist of a flexible plastic film, such as is sold by Hercules, Inc. under the designation XK-30, in which a static electrical charge has been induced. Such films are available in either substantially transparent or substantially opaque form, and may be erasably written upon with dry erase markers.

In accordance with the invention, a supply of electret film 24 is disposed adjacent plate 10 so that film may be conveniently dispensed from the supply to the plate 10. In the preferred embodiment of the invention, the supply of electret film comprises a roll 30 of electret film material housed in a receptacle 16 from which it may be withdrawn. Receptacle 16 is detachably secured to the flip chart stand by brackets 14. The apparatus also includes means for facilitating dispensing electret film material in sheet form. In the first embodiment, this means includes a cutting assembly 17, known per se and shown in perspective in FIG. 3, which includes a cutting stage 18 detachably secured (by means not shown) to plate 10, a blade holder 22 including blade 23 which is slideably mounted for lateral movement along a guide 20 which is spaced from cutting stage 18 so as to permit material 24 to pass between cutting stage 18 and guide 20. Cutting stage 18 may include a groove or channel 25 to receive and guide blade 23 during cutting. Cutting assembly 17 is desirably detachably secured to plate 10, such as by mating pieces of hoop and loop fasteners sold under the trademark VELCRO disposed on each of them. Material 24 may be withdrawn from receptacle 16, fed through cutting assembly 17, withdrawn so that a desired amount of material is below cutting assembly 17, and cut to provide a sheet by laterally moving blade holder 22 so that the blade therein severs the electret film. The sheet of material 24 thus formed may be moved as desired to position it for writing with respect to plate 10, and will adhere to the surface of plate 10 due to the electrostatic attraction between the charges in the electret film and the induced charges in plate 10. The sheet of material thus formed provides a convenient writing medium. When the first side of sheet has been filled, it may be erased and rewritten upon or it may be reversed so that the second side may be used.

An important feature of the invention is that sheets dispensed by means of receptacle 16 and cutting means 17 may be stacked on plate 10. Since sheets of electret film material adhere to each other as well as to different materials, such sheets may be dispensed one over top of another to form successive overlays. With the subject material described above, stacks in excess of 50 sheets thick have been secured to a plate 10 solely by means of the electrostatic attraction of the sheets.

A further advantage of the invention is that other sheet materials will adhere to the electret film by virtue of electrostatic attraction. Accordingly, preprinted sheets of ordinary material such as paper, of any size less than about the electret film sheet size, may be placed against the uppermost sheet of electret film material and will adhere thereto. Such preprinted sheets may also be disposed between layers of electret film material. Such preprinted sheets may be used to display information relating to material already displayed on the apparatus, or to form a background visible through succeeding transparent electret film layers overlaid on the preprinted layer, or both. Such capability greatly facilitates presentations in which a portion of the presentation is to be repetitively used in successive presentations. Such portions may be preprinted on sheets of material, either electret film or ordinary materials such as paper, placed upon the display apparatus, and overlaid with transparent materials so that the presenter may erasably write upon the transparent material without destroying the background information.

FIG. 2 shows a side view of the apparatus shown in FIG. 1. As shown therein, receptacle 16 is detachably secured to a chart stand comprising legs 12 and plate 10 by means of brackets 14, which are shown in perspective in FIG. 4. Bracket 14 includes a generally U-shaped upper portion 15 for supporting receptacle 16 and an elongated lower portion 13 for detachably securing the bracket 14 to the legs 12 of a chart stand. The lower portion 13 of the bracket 14 includes a pair of U-shaped portions 42 adapted to be placed over leg 12 to aid in securing bracket 14 thereto. U-shaped portions 42 are provided with threaded holes into which screws 44 are threaded, whereby when screws 44 are tightened the leg 12 is clamped between the screw 44 and the opposite portion of U-shaped portion 42.

Receptacle 16 is removably mounted in bracket 14 so as to dispense electret film material 24 in the direction of plate 10. In the embodiment shown, receptacle 16 comprises a box-like structure adapted to receive a roll 30 of electret film material 24 therein. Receptacle 16 comprises a generally concave box-like portion 34 and a cover portion 46 hinged thereto at 40 whereby the receptacle 16 may be opened for insertion or removal of a roll 30 of material and for storage and access to the interior of receptacle 16. Cover 46 may be hinged to concave portion 34 by separate hinges or by a flexible hinge region integrally molded into receptacle 16. Roll 30 includes an axle 32 which is rotatably mounted at each end thereof in cradles 48 disposed at the ends of receptacle 16. Cradles 48 may include a cutaway portion for facilitating insertion and removal of the axle ends into the cradle. Receptacle 16 includes a slot-like aperture 38 through which the electret film 24 may be fed in order to conduct same to a writing position on plate 10. Receptacle 16 may be constructed of plastic or any other suitable material.

Receptacle 16 is desirably sized so as to accommodate within its interior space the brackets 14 and the cutting assembly 17, as well as the roll 30 of electret film material. In this way, these components may be easily stored and/or transported to a site for assembly together with a flip chart stand at the site.

FIGS. 5 and 6 show other embodiments of electret film dispensing film apparatus which, like the embodiment of FIGS. 1–4, are useful as substitutes for paper flip charts.

Figure 5A:
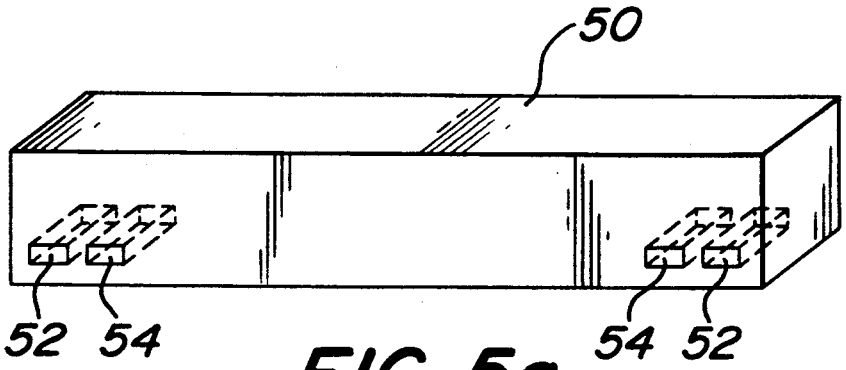
FIGS. 5*a*, 5*b*, and 5*c* are illustrations of a receptacle, bracket, and cutting assembly, respectively, of a second embodiment of the invention.
Figure 5C:
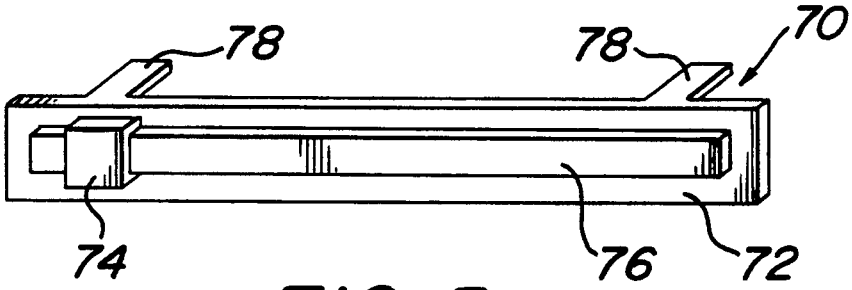
Figure 5B:
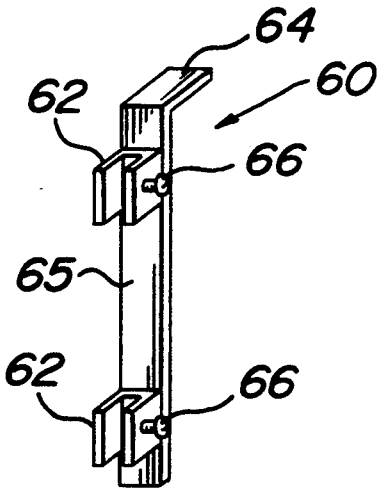

FIGS. 5*a*, 5*b*, and 5*c* show a second embodiment of the invention which is a modification of the first embodiment suitable for use with flip chart stands in which a non-removable pad clamp at the top of plate 10 interferes with attachment of cutting assembly 17 to plate 10. This second embodiment also includes an alternative means for detachably securing the bracket to the receptacle.

FIG. 5*a* shows a receptacle 50 generally similar to receptacle 16 shown in FIG. 1, but which further includes an outer pair of slots having openings 52 and an inner pair of slots having openings 54, all of which openings are in the lower front edge of the receptacle and all of which slots extend perpendicular to the front surface into the interior of the receptacle. Such slots may, for instance, be molded into receptacle 50. FIG. 5*b* shows a bracket 60 including U-shaped portions 62 secured to member 65 and having screws 66 for clamping bracket 60 to a leg 12 of a flip chart stand. Instead of a U-shaped upper portion for cradling the receptacle, as shown in FIG. 4, the bracket 60 of FIG. 5*b* includes a tab-like portion 64 adapted to be inserted in one of the slots 52 in receptacle 50 for supporting receptacle 50 when brackets 60 are clamped to a flip chart stand. FIG.

5c shows the general features of a cutting assembly 70 having a cutting stage 72, a blade holder 74 and a guide 76 identical to the corresponding members illustrated in FIG. 3. Cutting assembly 70 differs from that shown in FIG. 3 in that it further includes tab-like projections 78 which are adapted to be inserted into slots 54 of receptacle 50 so as to detachably secure cutting stage 72 to receptacle 50. Desirably, receptacle 50 includes sufficient internal space to store both cutting assembly 70 and brackets 60 in addition to the electret material for convenience of transport.

Figure 6A:
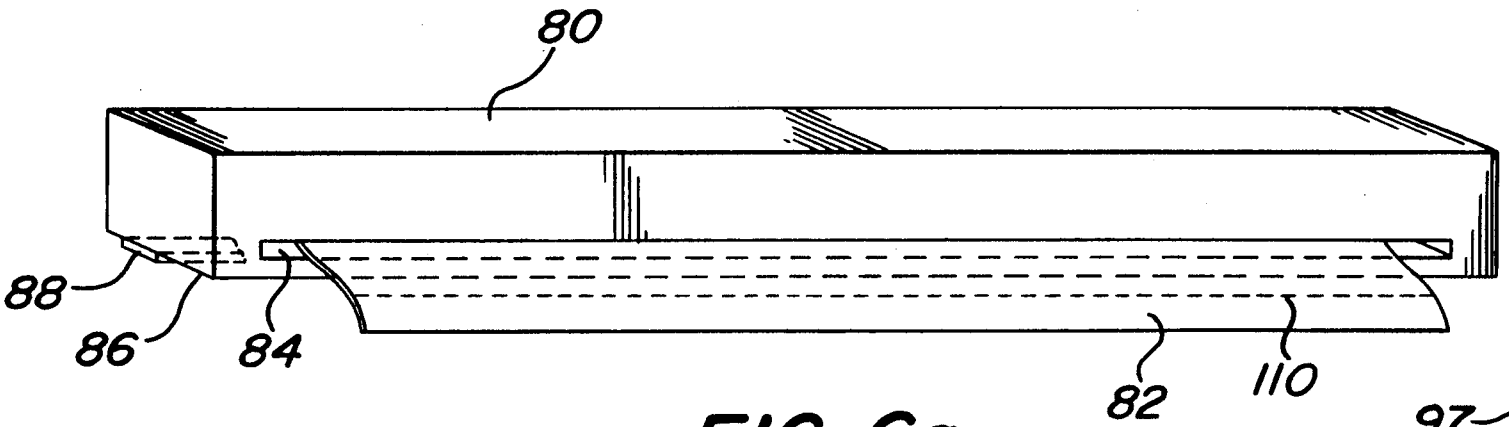
FIG. 6*a*, 6*b*, and 6*c* are illustrations of a receptacle, bracket and cutting assembly, respectively, of a third embodiment of the invention.
Figure 6B:
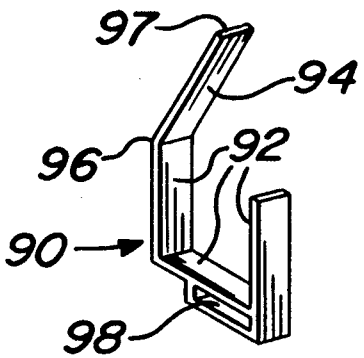
Figure 6C:
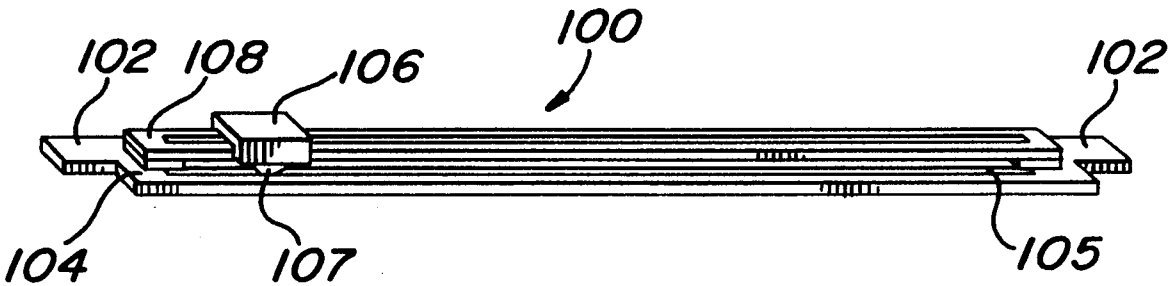

FIG. 6 shows a third embodiment of the invention which is useful particularly when the width of the electret film material to be used is greater than the width of standard flip chart holders. The third embodiment includes a receptacle 80 housing a supply of electret film 82, desirably in the form of a roll, which is dispensed through a slot 84 in the bottom surface of the receptacle. FIG. 6b shows in perspective a bracket, a pair of which may be disposed around receptacle 80 at the left and right ends thereof in order to support a cutting assembly 100 as shown in FIG. 6c adjacent the slot 84. Bracket 90 includes a U-shaped portion 92 adapted to receive within it receptacle 80, and a hinged portion 94 hinged at 96 to U-shaped portion 92 and which desirably includes latch means (not shown) at the opposite end 97 of portion 94 to latch it to U-shaped portion 92 to secure receptacle 80 within bracket 90. Bracket 90 further includes a slot 98 adapted to receive one of the laterally projecting tabs 102 of cutter 100. Except for the tabs 102, cutter 100 is in all respects like the cutters shown in FIGS. 3 and 5c, including a cutting stage 104, a groove or channel 105, a blade holder 106, a blade 107, and a guide 108.

Apparatus according to the third embodiment, comprising a receptacle 80 and a cutting assembly 100 secured thereto by a pair of brackets 90, is adapted to be mounted to a vertical surface such as a wall or a chalk board, with the rear surface 86 of receptacle 80 adjacent and parallel to such surface and the electret film 82 withdrawn downwardly through slot 84 and cutter 100 so that electret film 82 may be dispensed in sheet form onto the vertical surface below the apparatus. Apparatus comprising a receptacle 80, brackets 90, and cutting assembly 100 may be removably mounted to a vertical surface by any suitable means, such as a strip of VELCRO or similar hook and loop fastening material 88 (partially shown in FIG. 6a) affixed to the rear surface of receptacle 80 for mating with a piece of Velcro mounted on the vertical surface.

Various modifications of the apparatus of the first three embodiments may be made while still fulfilling the function of delivering electret film material to a supporting surface in sheet form. For instance, the cutting assembly may be dispensed with and the roll of material provided with frangible means such as lines of perforations 110 as shown in FIG. 6a or other weakened zones to facilitate tearing off sheets without use of a cutting member. Alternatively, the receptacle may be provided with blade means such as a serrated or otherwise sharp edge adjacent the slot, e.g. slot 38 in FIG. 2 may comprise a sharpened or serrated edge, so that the material may be cut against it by pulling the sheet in a fashion analogous to that used with kitchen wrapping materials such as aluminum foil and plastic film wrap. Such alternatives are believed to be less desirable than the blade cutter shown because they are less convenient and they tend to distort the material when it is torn. It will also be understood that cutting into sheets may be effected by a moveable blade which is not guided by a guide assembly as shown. Other modifications may also be made, such as disposing a supply of material adjacent the plate without housing it in a receptacle, or supporting the supply of material by a slotted bracket assembly which slips over the top edge of the plate of a flip chart stand.

It is thus seen that the writing apparatus of the present invention, including electret film material as a writing medium, provides erasable and reusable writing surfaces which may be conveniently and inexpensively used in a variety of display, presentation and educational applications. While particular apparatus has been disclosed, the various modifications will no doubt occur to those skilled in the art without departing from the spirit and scope of the invention, which is not to be limited to the particular embodiments shown.

What is claimed is:

1. A method of providing a writing surface suitable for presentation and display application comprising the steps of:

disposing a roll of flexible electret film material, which is capable of being erasably written upon with dry erase markers, adjacent a generally vertical surface;

withdrawing a portion of said material from said roll;

adhering said withdrawn portion of said material to said generally vertical surface by means of electrostatic attraction; and, separating said withdrawn portion of said material from the remainder of said material while said withdrawn portion adheres to said generally vertical surface.

2. A method according to claim 1, wherein said electret film material includes frangible means integral therewith for facilitating separating withdrawn portions from the remainder of said material, and said separating step includes breaking said material at said frangible means.

3. A method according to claim 1, wherein said separating step includes cutting said material using blade means.

* * * * *